United States Patent [19]

Chang

[11] Patent Number: 4,838,470

[45] Date of Patent: Jun. 13, 1989

[54] STAPLER BASE

[76] Inventor: Ted S. Chang, 3F., No. 27, Lane 154, Hsing I Road, Pei Tou District, Taipei, Taiwan

[21] Appl. No.: 166,045

[22] Filed: Mar. 9, 1988

[51] Int. Cl.[4] ..... B25C 5/02

[52] U.S. Cl. ..... 227/120; 227/156

[58] Field of Search ..... 227/120, 128, 156

[56] References Cited

U.S. PATENT DOCUMENTS 2,073,819 3/1937 Vogel ..... 227/128

2,915,753 12/1959 Ruskin ..... 227/128

2,939,146 6/1960 Abrams ..... 227/120

*Primary Examiner*—Frank T. Yost

*Assistant Examiner*—James L. Wolfe

*Attorney, Agent, or Firm*—Bernard R. Gans

[57] ABSTRACT

A base for use with a tacker. The base includes a plate fixed on a first cavity at the front side thereof with a rivet. A groove is disposed in the plate. A bending plate is attached to the rear end of a resilient plate such that the staple remover of a tacker can be set within the bending plate, thus forming an assembly which can be utilized to staple a thick stack of paper.

1 Claim, 7 Drawing Sheets

STAPLER BASE

BACKGROUND OF THE INVENTION

The present invention relates to a stapler base, and more particularly to a device which can be used with a tacker to provide a function similar to an ordinary stapler.

Traditionally, tackers are used in the manufacture of furniture or decorations. However, due to the inherent construction of the tacker, it is not suitable for stapling a thick stack of papers. On the other hand, the conventional stapler is not very useful when a thick stack of paper is to be fixed together, either.

SUMMARY OF THE INVENTION

The purpose and objective of this invention is to provide a device which can be used to cooperate with a traditional tacker and to achieve the goal of stapling a thick stack of papers or the like.

Other advantages and merits of this invention will become apparent as the following description proceeds.

DETAILED DESCRIPTION OF THE PREFERRED EMBODIMENT

Figure 1:
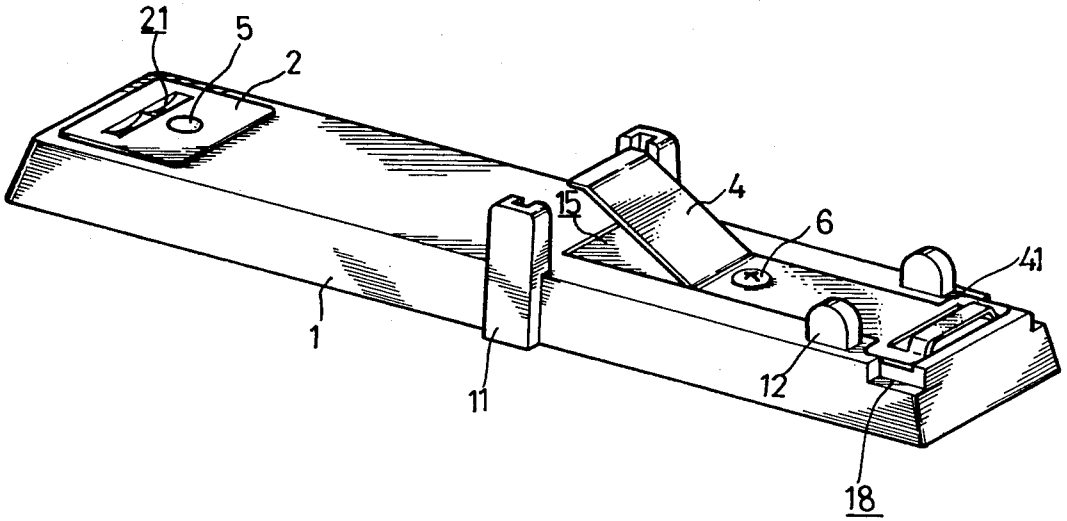
FIG. 1 is a perspective view of a staple base in accordance with the present invention.
Figure 2:
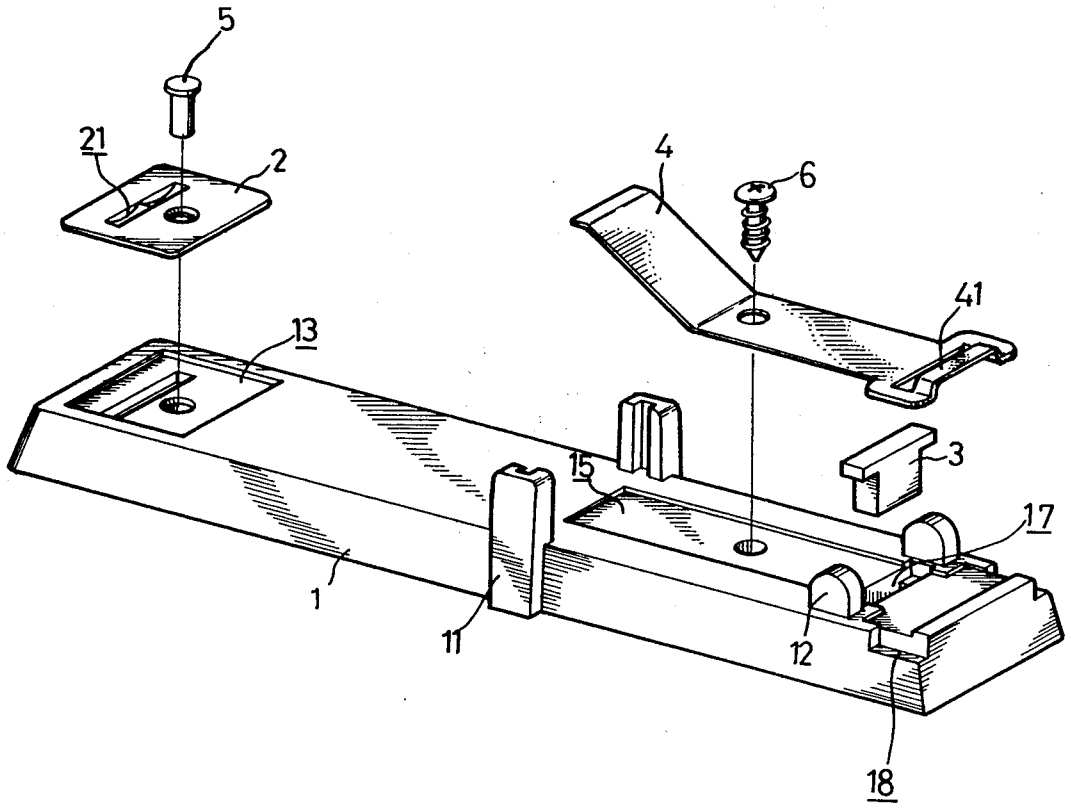
FIG. 2 is an exploded view of the staple base of FIG. 1 in accordance with the present invention.
Figure 3:
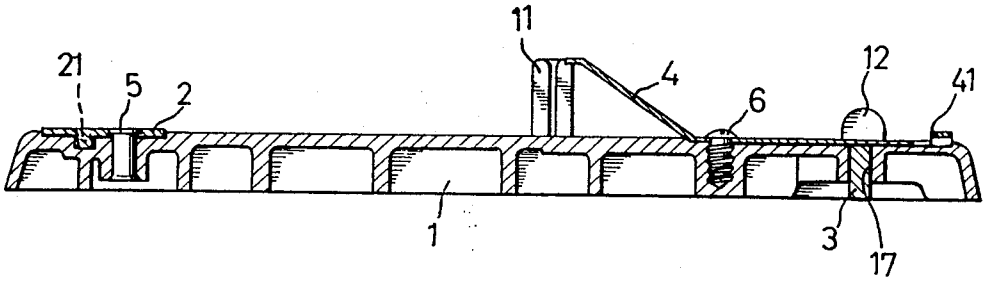
FIG. 3 is a side view of the staple base of FIG. 1 in accordance with the present invention.

Referring to FIGS. 1, 2 and 3, it can be seen that a staple anvil of this invention has a plate 2 fixed on a first cavity 13 at the front side of a base 1 with a rivet 5. A groove 21 is disposed in the plate 2. At the middle of the base 1, there is disposed a holder 11 on each side thereof. A resilient plate 4 is mounted on a second cavity 15 at the rear side of the base 1 with a bolt 6. A projection 12, as well as a recess 18, are disposed on each side of the rearmost end of the base. A bending plate 41 is attached to the rear end of the resilient plate 4. A T-shaped block 3 is put into a block groove 17 wherein the top surface of the T-shaped block 3 is in planar alignment with the second cavity 15.

Figure 4:
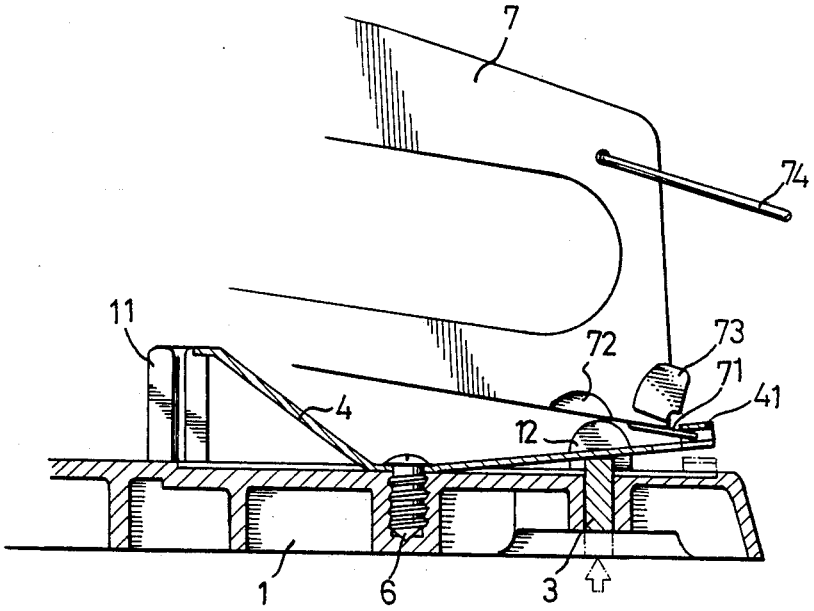
FIG. 4 shows the assembly of a conventional tacker and the staple anvil.
Figure 5:
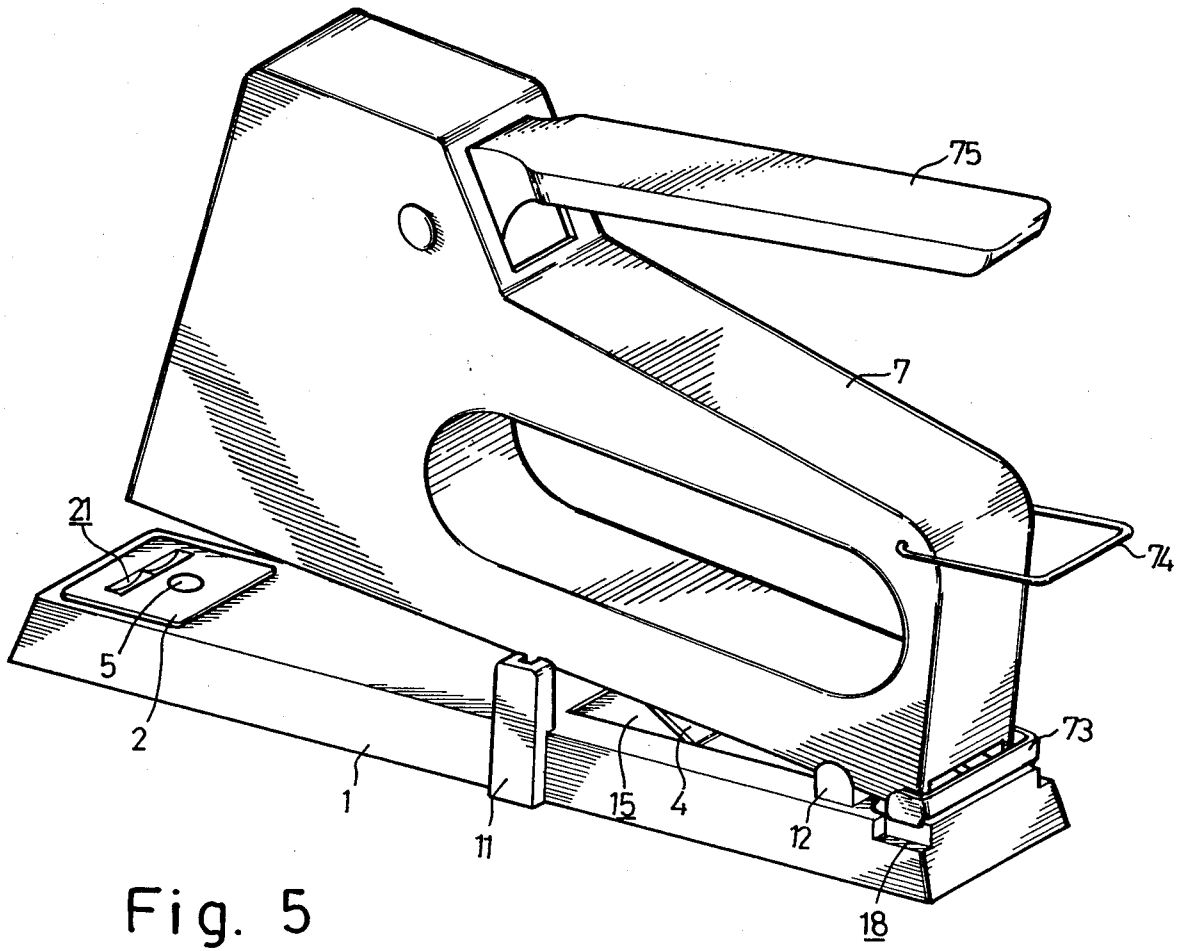
FIG. 5 is a perspective view of the staple base in accordance with the present invention assembled with a conventional tacker.

Referring now to FIGS. 4 and 5, it can be understood that when a tacker 7 is to be assembled with the staple anvil of the present invention, the T-shaped block 3 is pushed upwards so that the rear portion of the resilient plate 4 is raised and a tacker 71 of the staple driver 7 can be easily received in the bending plate 41 of the resilient plate 4. After the staple remover fits in the bending plate and an arched groove 72 on both of the lateral sides of the tacker is seated on the projection 12, the T-shaped block 3 is released and the assembly of the tacker and the staple anvil of this invention is completed. As a result of projections 12 and arched grooves 72, the tacker can be mounted on the stapler base 1 firmly and in a certain position.

The holders 11 on each side of the staple anvil are to make sure that the tacker will be in right position after it is pressed. The recess 18 is for easy filling of the staples after the assembly is complete.

Figure 6:
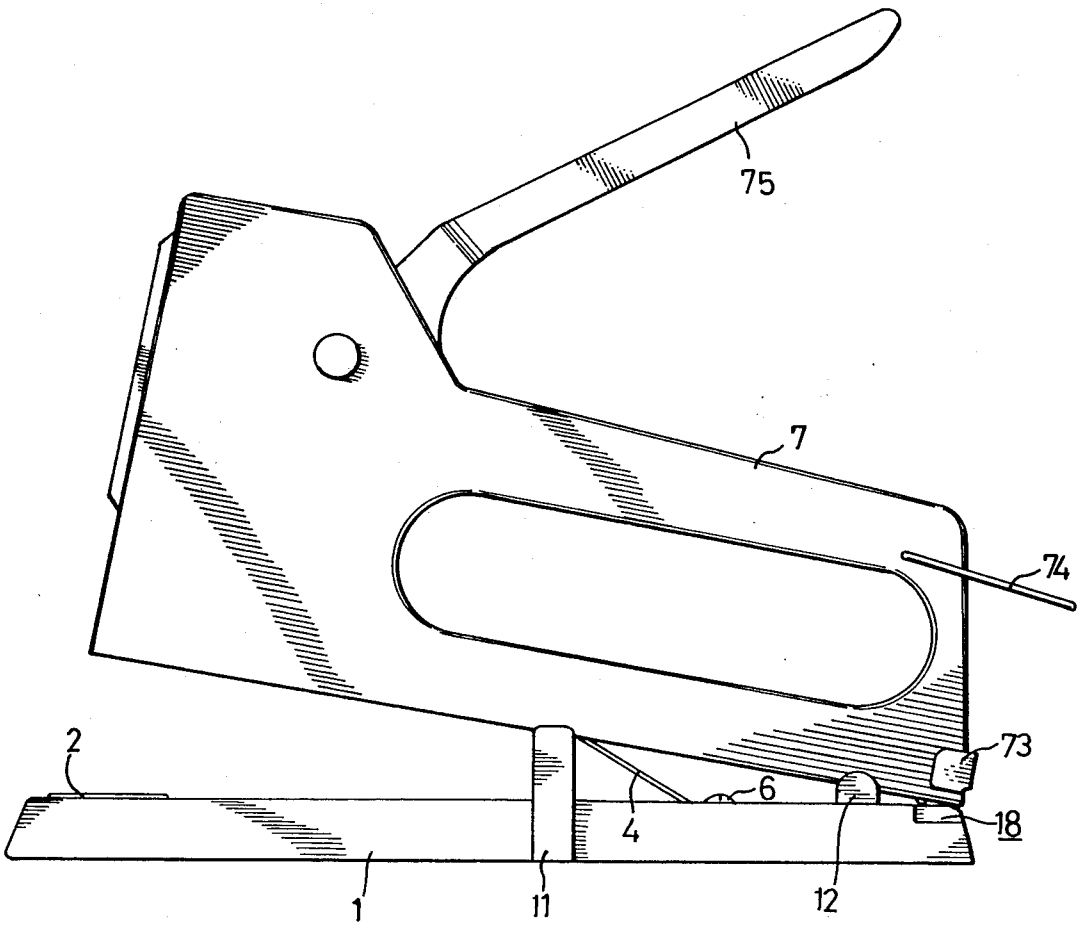
FIG. 6 is a side view of the assembly of FIG. 5.
Figure 7:
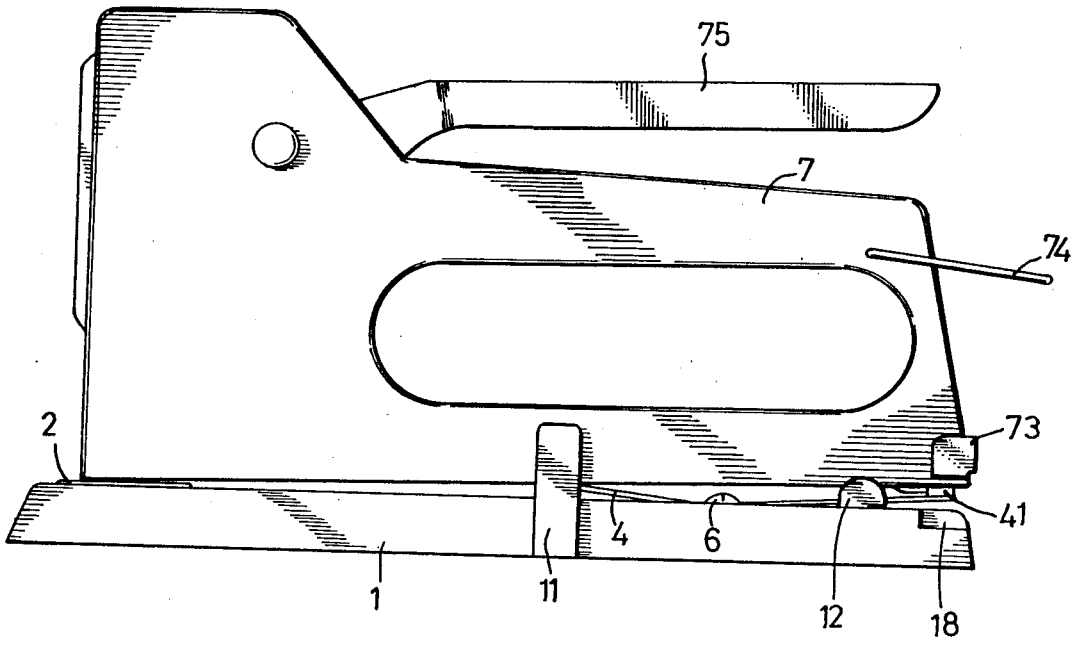
FIG. 7 is a working view of the assembly in FIG. 5.

With reference to FIGS. 6 and 7, it can be seen that in order to use this invention, a stack of paper is put above the groove 21 of the plate 2 where it is to be stapled. Then the handle 75 is pressed, and a staple is driven out into the stack of the paper. Due to the presence and shape of the groove 21 of the plate 2, the tail ends of the staple driven out of the paper will be bent inwards. Thus, the stack of paper is stapled together just like accomplished with an ordinary stapler. Moreover, the length of the handle 75 is long, so that the force exerted on the handle 75 is less than on an ordinary stapler.

It can be clearly seen that the present invention provides a novel device which can be used to cooperate with a conventional tacker to staple a thick stack of paper easily while it is difficult or impossible to accomplish the same with a commerciallyavailable stapler.

I claim:

1. A stapler base for use with a tacker to staple a thick stack of paper, comprising:

(a) a base (1);

(b) a plate (2) disposed in a first cavity (13) at a front side of said base (1), said plate being attached to said base (1) by a rivet (5);

(c) said plate (2) having a groove (21) therein;

(d) holder means (11) attached to each side of said base (1) at a middle portion of said base (1) for positioning said tacker during pressing of said tacker;

(e) resilient plate means (4) mounted in a second cavity (15) at a rear side of said base (1), said plate means being attached to said base (1) by a bolt (6), said plate means (4) for resiliently supporting said tacker;

(f) a projection (12) and a recess (18) being disposed on each side of a rearmost end of said base (1), a rear end of said tacker being seated on said projections (12) so that arched grooves (72) in said tacker engage said projections (12);

(g) a bending plate (41) attached to a rear end of said resilient plate means (4);

(h) T-shaped block means (3) slidably engaging a block groove (17) in said base (1) such that a top surface of said T-shaped block means (3) is in planar alignment with said second cavity (15) in a first position, said T-shaped block means (3) for raising a rear portion of said resilient plate means (4) by pushing said T-shaped block means (3) upward to a second position so that a staple remover (71) attached to said tacker can be engaged to said bending plate (41) in order to assemble said tacker to said base (1).

* * * * *